US006384855B1

(12) United States Patent
Miller et al.

(10) Patent No.: US 6,384,855 B1
(45) Date of Patent: May 7, 2002

(54) THERMAL TRANSFER PRINTER

(75) Inventors: Norbert Miller; Dipl.-Ing Peter Höffges, both of Mönchengladbach (DE)

(73) Assignee: Scheidt & Bachman GmbH (DE)

( * ) Notice: Subject to any disclaimer, the term of this patent is extended or adjusted under 35 U.S.C. 154(b) by 0 days.

(21) Appl. No.: 09/474,509

(22) Filed: Dec. 29, 1999

(30) Foreign Application Priority Data

Jan. 2, 1999 (EP) ..... 99100004
Apr. 22, 1999 (EP) ..... 99107934

(51) Int. Cl.[7] ..... B41J 2/325
(52) U.S. Cl. ..... 347/215
(58) Field of Search ..... 347/19, 218, 217, 347/215, 213, 102; 400/73, 586

(56) References Cited

U.S. PATENT DOCUMENTS 4,910,602 A * 3/1990 Sakuragi ..... 347/215
4,973,983 A * 11/1990 Yamamoto et al. ..... 347/214
5,354,134 A * 10/1994 Patry ..... 400/73
5,611,629 A * 3/1997 Paranjpe ..... 347/172
5,838,342 A * 11/1998 Takahashi et al. ..... 347/19
5,896,154 A * 4/1999 Mitani et al. ..... 347/102
6,097,415 A * 8/2000 Kita et al. ..... 347/213
6,132,120 A * 10/2000 Yamgauchi ..... 400/586
6,262,755 B1 * 7/2001 Skubic et al. ..... 347/173

FOREIGN PATENT DOCUMENTS

| | | |
|---|---|---|
| EP | 0 816 108 | 1/1998 |
| EP | 0 856 408 | 8/1998 |
| JP | 61 102277 | 5/1986 |
| JP | 09 309239 | 12/1997 |

* cited by examiner

*Primary Examiner*—N. Le
*Assistant Examiner*—K. Feggins
(74) *Attorney, Agent, or Firm*—Cantor Colburn LLP

(57) ABSTRACT

A thermal transfer printer in which the tape speed of the thermal transfer tape and the feed rate of the object medium to be imprinted can be synchronized in simple fashion and which displays little susceptibility to malfunctions, is to be realized by providing a drive unit for the direct, positive drive of the thermal transfer tape, moving the thermal transfer tape past the print head at a tape speed that is synchronized with the feed rate of the object medium to be imprinted.

22 Claims, 2 Drawing Sheets

THERMAL TRANSFER PRINTER

TECHNICAL FIELD

This invention relates to a thermal transfer printer consisting of a guide for the object medium to be imprinted as well as a print head and a print unit incorporating a transport assembly for the thermal transfer tape.

BACKGROUND OF THE INVENTION

In a thermal transfer printer, an object medium is imprinted by means of a thermal transfer tape which, during the printing process, travels past the print head in synchronism with the feed rate of the object medium to be imprinted. The thermal transfer tape consists of a substrate on which at least one ink or dye is deposited. During the printing process the print head heats up individual points of the thermal transfer tape that travels past it, corresponding to the image to be imprinted on the object medium, causing dye particles to be fused, separated from the substrate and adhesively transferred to the object medium.

For the flawless imprinting of an object medium it is necessary for both the medium and the thermal transfer tape to move past the print head at precisely the same speed. In prior art, the feed rate of the object medium and the speed of travel of the thermal transfer tape are synchronized by various control elements. The drawback in this case, however, is the typically complex design of these elements with attendant susceptibility to breakdown, and in the event of a malfunction any corrective action usually tends to be quite expensive in terms of time and money.

SUMMARY OF THE INVENTION

Given the said prior art, it is the objective of this invention to provide a thermal transfer printer which allows for simple synchronization of the thermal-transfer tape speed and the feed rate of the object medium, and which displays little susceptibility to breakdowns.

The technical solution offered by this invention is a thermal transfer printer which is characterized in that it incorporates a direct, positive drive for the thermal transfer tape, moving the thermal transfer tape past the print head at a speed that matches the feed rate of the object medium to be imprinted.

The thermal transfer printer offered by this invention permits considerably improved synchronization of the thermal-transfer tape speed and the feed rate of the object medium to be imprinted.

The thermal transfer printer according to this invention incorporates a transport mechanism for the thermal transfer tape which consists essentially of a drive unit, a supply spool, a pickup spool and guide rollers. For printing on an object medium, fresh, unused thermal transfer tape is unreeled off the supply spool, guided past the print head by means of suitable guide rollers and, upon imprinting the object medium, wound onto the pickup spool as spent thermal transfer tape. Most desirably, both the pickup spool and the supply spool are in the form of cylindrical drums exchangeably mounted in the thermal transfer printer. The drive unit for transporting the thermal transfer tape consists of a motor and at least one motor-driven drive cylinder. In operation, the drive unit moves the thermal transfer tape past the print head at a tape speed that matches the feed rate of the object medium to be imprinted.

According to another desirable feature of the invention, the drive cylinder is in direct contact with the circumference of the cylindrical pickup spool, driving the latter at a constant circumferential speed independent of the diameter of the tape coil, as a result of which the thermal transfer tape will always travel past the print head at a linearly constant tape speed.

As another desirable feature offered by this invention, the pickup spool is displaceable relative to the drive cylinder so that, even as the diameter of the coiled tape increases, the positive drive action by the drive cylinder that is in contact with the circumference of the pickup spool is maintained. This is accomplished by suspending the exchangeable pickup spool in elongated slots.

As another desirable feature according to this invention, the drive cylinder is provided with a heating element which heats up as the thermal transfer tape is wound onto the cylindrical pickup spool. Energizing the heating element causes the thermal transfer tape traveling past the drive cylinder to be briefly heated up before being wound onto the cylindrical pickup spool, as a result of which the individual layers of the thermal transfer tape on the pickup spool adhere to one another. The mutually adhering layers of the thermal transfer tape wound on the pickup spool can no longer slip and slide relative to one another, the desirable result being a tight coiling of the thermal transfer tape onto the cylindrical pickup spool. The preferred heating element is a resistor and preferably a PTC resistor. As another desirable, proposed feature of this invention, the heating element is rod-shaped and protrudes into a circular groove in the drive cylinder.

As another desirable feature offered by this invention, the guiding of the thermal transfer tape is aided by an additional guide roller which is preferably in the form of a tapered, cylindrical centering roller serving to center the thermal transfer tape on the pickup spool. The centering roller is preferably suspended in an elongated slot which allows it to be retracted upwards into a standby position, thus facilitating the loading of the thermal transfer tape.

According to another advantageous aspect of this invention, the cylindrical pickup spool incorporates a braking mechanism as well as a free-wheeling capability. The braking mechanism assures both a defined, dependable protection against unraveling and a short rewind path. In desirable fashion, both features help prevent any breaking of the thermal transfer tape and permanently keep the thermal transfer tape sufficiently taut. The free-wheeling capability advantageously permits manual rewinding of the thermal transfer tape.

As another desirable feature of the invention, the guide system for the object medium to be imprinted is positioned opposite the print head at a distance that defines a working area, the said guide system incorporating a transport as well as an adjustment device by which the distance between the guide system and the print head can be varied. The guide system serving to channel the object medium is designed to allow the print head and the object medium to be brought together in desirable fashion, whereby it is not the print head that is moved toward a positionally fixed object medium but, instead, the guide system moves the object medium toward the print head into printing position.

As another desirable feature offered by the invention, the transport consists of a transport belt and a belt drive, the transport belt guided by at least two guide rollers which are positioned in a plane essentially parallel to the print unit. Most desirably, the transport belt forms a continuous loop and is driven by a stepping motor via the guide rollers. The transport belt carries an object medium, sheet-fed into the thermal transfer printer, past the print unit along a plane essentially parallel to that of the print unit, with the space between the object medium transported by the belt and the print unit being adjustable. The medium-accommodating working space created by mounting the transport at a distance from the print head makes it possible in desirable fashion to feed in object media of various thicknesses.

As another advantageous feature of the invention, the guide system encompasses an adjustment capability consisting of a drive and a motion transfer assembly, with at least part of the motion transfer assembly positioned within the continuous loop of the transport belt and movable in relation to the latter. The motion transfer assembly is positioned opposite the print unit at a distance that defines a working space, with a displacement of the motion transfer assembly in a direction essentially perpendicular to the print unit permitting the distance between the object medium and the print unit to be augmented and reduced as required.

After an object medium to be imprinted is introduced in the working space between the print unit and the guide system, it is fixed in its position and, by a displacement of the motion transfer assembly toward the print unit, it is moved up to the print unit that contains the print head. Thus, the thermal transfer printer according to this invention makes it possible to bring the print unit and the object medium to be imprinted together regardless of the thickness of the object medium. The motion transfer assembly and the print unit face each other, which results in a straight, linear feed movement of the motion transfer assembly. As a consequence, even when object media of various thicknesses are fed in, no further adjustment of the motion transfer assembly is necessary.

As another advantageous feature of this invention, both the linear tape speed of the thermal transfer tape traveling past the print head and the linear feed rate of the transport belt carrying the object medium are adjustable. As a particularly desirable feature, a control unit is provided which synchronizes the tape speed of the thermal transfer tape and the feed rate of the transport belt.

For the thermal transfer printer according to this invention, a positive-drive unit is proposed which acts directly on the thermal transfer tape and which in desirable fashion moves the thermal transfer tape past the print head at a linearly constant tape speed. The drive unit is preferably a motor and at least one drive cylinder which latter is in direct contact with the circumference of the cylindrical pickup spool, driving the spool. With this configuration of drive cylinder and pickup spool the pickup spool will always be driven at the same circumferential speed and the tape speed will always remain constant regardless of the diameter of the coiled tape on the spool. The speed of the thermal transfer tape is preferably selectable. The guide system of the thermal transfer printer, serving to feed in the object medium, preferably consists of a transport and an adjustment device, with the transport and the adjustment device coupled to each other, thus obviating the need for an additional transport and adjustment synchronizing provision for feeding the object medium to the print unit. The guide system and the print unit face each other at a distance that defines a working space between them, whereby an object medium introduced in the thermal transfer printer is moved past the print head by means of a transport belt in a plane essentially parallel to the print head. In desirable fashion, the transport belt is driven by a stepping motor in a manner that the object medium carried by the transport belt is fed to the print head at a linearly constant speed. The feed rate of the object medium carried by the transport belt is preferably adjustable. Due to the fact that both the thermal-transfer tape speed and the feed rate of the object medium are linearly constant while the said tape speed and feed rate are nevertheless adjustable, the thermal transfer tape can travel past the print head in synchronism with the object medium.

For printing on the object medium, the motion transfer assembly is shifted toward the print unit containing the print head, pushing the object medium against the latter. During that process the object medium is continually carried forward by the transport belt, thus permitting a continuous printing operation. Upon completion of the printing process the motion transfer assembly returns to its home position and the imprinted object medium is released from the print unit. In advantageous fashion, the guide system makes it possible for an object medium to move past the print unit at a certain distance without being pressed against the print unit by the motion transfer assembly.

Thus, in desirable fashion, the thermal transfer printer according to this invention assures synchronous travel of both the thermal transfer tape and the object medium past the print head as well as the synchronization of the transport and the adjustment device without requiring costly and complex control elements, making the thermal transfer printer according to this invention highly fail-safe and easy to maintain.

When the motion transfer assembly is displaced toward its lower end position in the direction opposite that of the print unit, a guide serving to center the thermal transfer tape is likewise moved downwards by virtue of its positive connection with the motion transfer assembly, providing an opening for the replacement of the thermal transfer tape.

Other advantages and features of this invention become evident from the following description with reference to the diagrams in which:

DETAILED DESCRIPTION OF THE INVENTION

Figure 1:
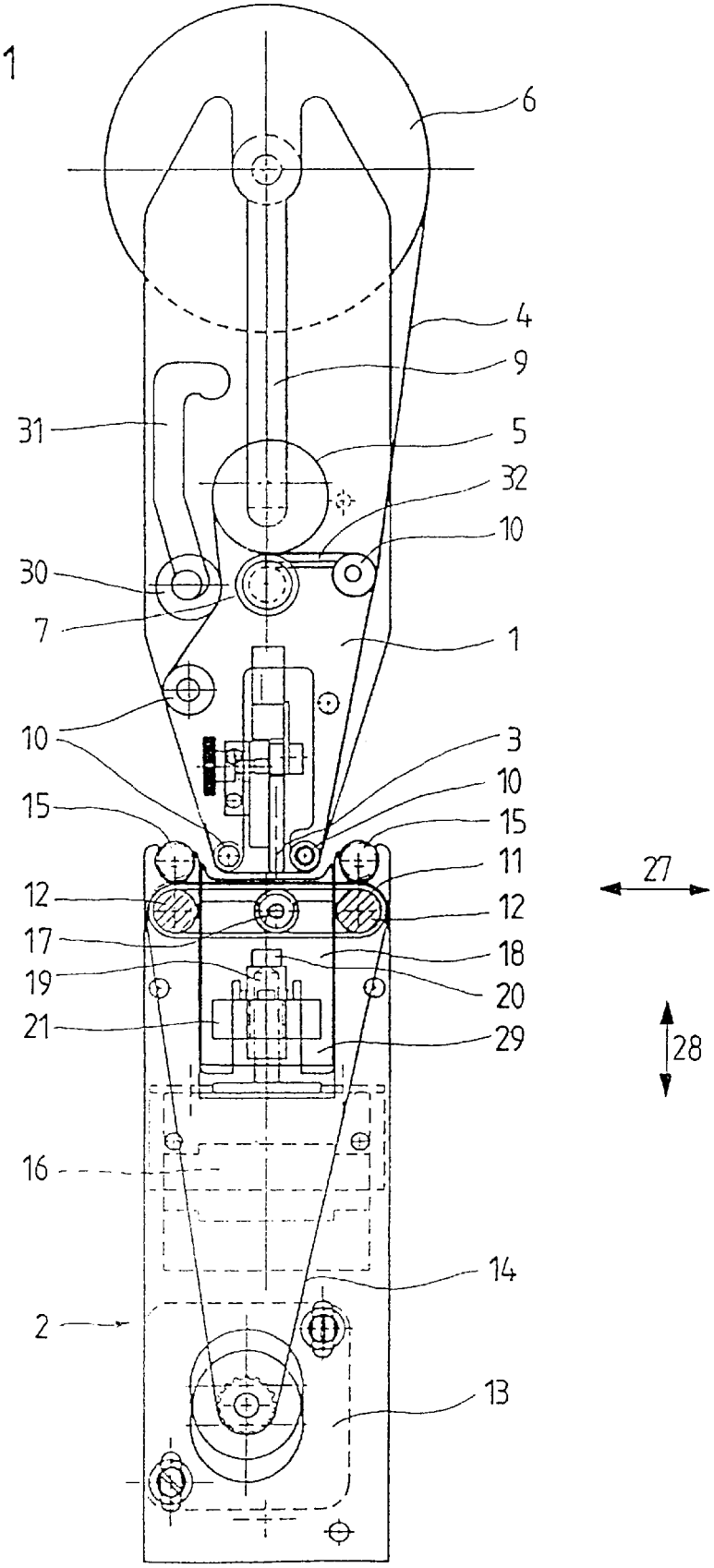
FIG. 1 shows a partly sectional front view of a print unit and a guide system.

FIG. 1 is a partly sectional front view of a print unit 1 and, opposite the latter at a distance that defines a working space, a guide system 2. The print unit 1 containing the print head 3 is positioned opposite the motion transfer assembly consisting of the pressure roller 17, the pressure yoke 18 and the drive, and is positionally fixed. By means of a continuous-loop transport belt 11, an object medium, not illustrated in this figure, is fed toward the print head 3 in a direction of travel 27 that is essentially parallel to the print unit 1, and into the working space between the print head 3 and the motion transfer assembly. In the situation illustrated in FIG. 1, the motion transfer assembly is in its home position, so that an object medium that has been introduced will move past the print head 3 without being imprinted.

Apart from the print head 3, the print unit 1 houses the transport mechanism for the thermal transfer tape 4, the mechanism consisting essentially of the drive unit, the supply spool 6, the pickup spool 5 and the guide rollers 10. During a printing process, the thermal transfer tape 4 is unreeled off the supply spool 6 and guided via the guide rollers 10 past the print head 3, whereupon the spent thermal transfer tape is wound onto the pickup spool 5. The drive unit for the transport mechanism consists of a drive cylinder 7 and a stepping motor 8. Additional traction for the thermal transfer tape 4 in the direction of the tape travel toward the pickup spool 5 is provided by another guide roller which is preferably in the form of a tapered centering cylinder 30 serving to center the spent thermal transfer tape 4 on the pickup spool 5 onto which it is to be wound. The centering cylinder 30 is suspended in a slot 31 allowing it to be moved up into a standby position leaving room to facilitate the loading of the thermal transfer tape 4. To move the centering cylinder 30 into its standby position, it is retracted upwards in the slot 31 and set into a recess at the upper end of the slot 31. After the thermal transfer tape 4 has been replaced, the centering cylinder 30 is lifted out of the recess and moved back into its home position. In that home position the centering cylinder 30 is supported in the slot 31 in such fashion that, when the thermal transfer tape 4 is to be centered on the pickup spool 5, the centering cylinder 30 exerts a corresponding amount of pressure on the thermal transfer tape 4 without inadvertently migrating back up in the slot 31.

Figure 2:
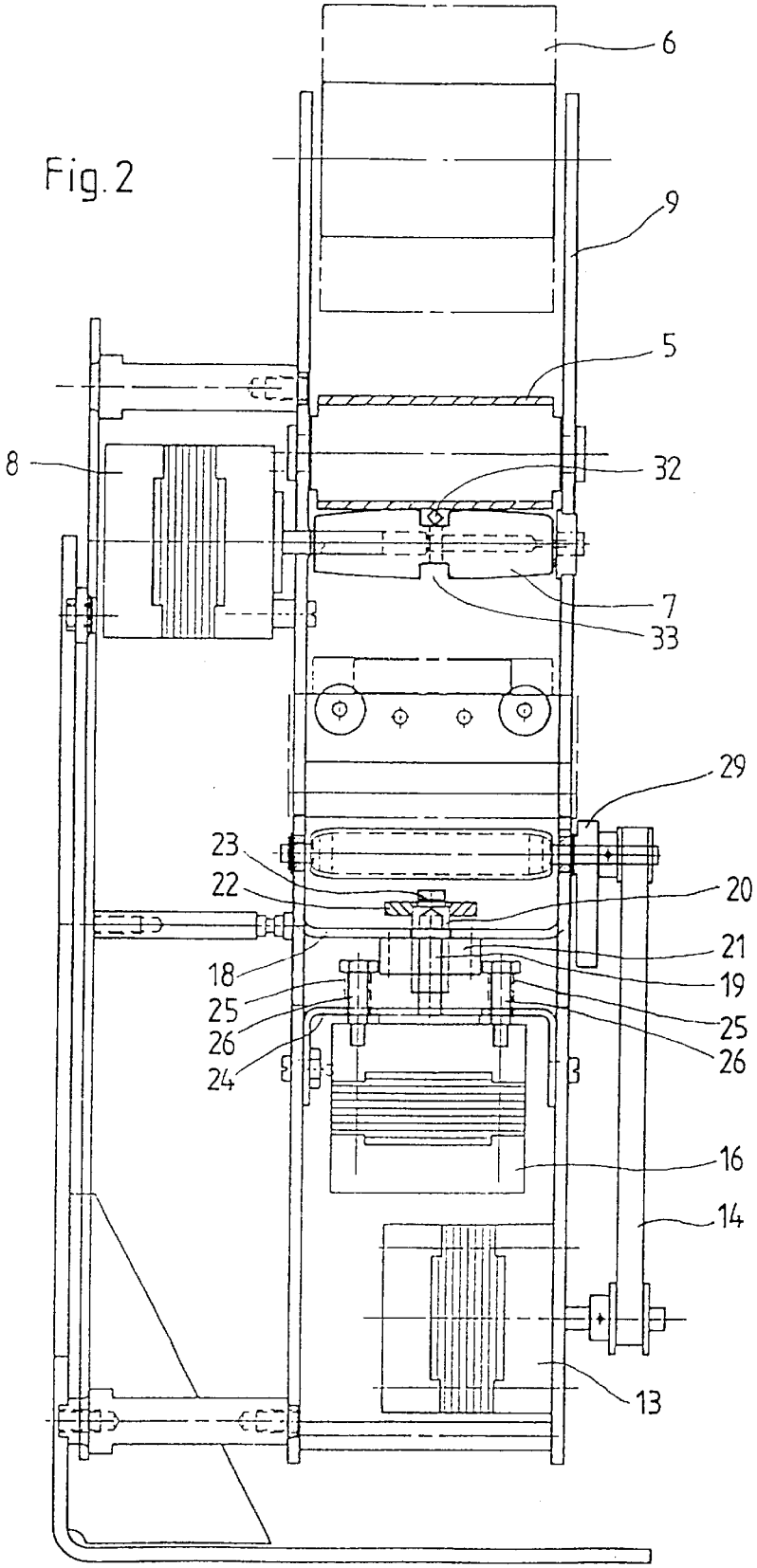
FIG. 2 shows a partly sectional side view of a print unit and a guide system.

The drive cylinder 7, rubber-clad and mounted directly on the shaft end of the stepping motor 8, is located underneath the cylindrical pickup spool 5 and is in direct circumferential contact with the latter. Regardless of the coiled diameter of the pickup spool 5, the drive cylinder 7 drives this spool at a constant, unchanging rate of circumferential rotation whereby the thermal transfer tape 4 is moved past the print head 3 at a linearly constant tape speed. The steady rate at which the thermal transfer tape 4, spent after a printing operation, is wound onto the pickup spool 5 causes the coiled diameter of the pickup spool 5 to steadily increase as the printing operation progresses. This, however, does not affect the tape speed of the as yet unspent thermal transfer tape 4 traveling past the print head 3 since the drive cylinder 7 drives the pickup spool 5 by its outer circumference, so that the circumferential speed of the pickup spool always remains the same even as the coiled diameter increases. The pickup spool 5 is suspended in elongated slots 9, causing it to steadily move upwards in the direction of displacement 28 as the coiled diameter increases, with a sensor tracking the changing position of the spindle of the pickup spool. A sensor of this type permits the indirect gauging of the amount of unspent thermal transfer tape 4 remaining on the supply spool 6. To prevent the thermal transfer tape from tearing, the supply spool 6 incorporates a brake mechanism which assures a defined unreeling resistance and thus a permanent measure of tautness of the thermal transfer tape 4. For tightly winding the thermal transfer tape 4, the print unit 1 is provided with a rod-shaped heating element 32 which protrudes into a groove 33 in the drive cylinder 7 and is in linear contact with the thermal transfer tape 4 to be wound. This is most clearly shown in FIG. 2. As the thermal transfer tape is wound onto the cylindrical pickup spool 5, the heating element 32, preferably in the form of a PTC resistor, is energized. As a result, the segment of the thermal transfer tape 4 traveling past the heating element at the drive cylinder 7 will be briefly heated up, thus causing the various layers of the thermal transfer tape wound onto the pickup spool 5 to adhere to one another. This prevents the individual layers of the coiled thermal transfer tape from slipping and sliding relative to one another, so that the thermal transfer tape 4 is tightly wound onto the pickup spool.

The guide system 2 includes the motion transfer assembly as well as the transport for the object medium to be imprinted. The motion transfer assembly on its part consists essentially of the pressure roller 17, the pressure yoke 18 bearing down on the latter, and a drive unit. The object medium to be imprinted, not shown in the drawing, is moved by means of the transport belt 11 in the direction of travel 27 along a plane that extends essentially parallel to the print unit 1, and is introduced in the working space between the print unit 1 and the guide system 2. The transport belt 11 runs over two guide rollers 12 in a continuous loop and is driven via these guide rollers 12 by a stepping motor 13. Depending on the direction of travel of the continuous-loop transport belt 11, the object medium to be imprinted can be moved in a direction of travel 27 both to the left and to the right relative to the plane of the diagram. The pressure roller 17 of the motion transfer assembly is located within the continuous loop of the transport belt 11 and can be moved by the stepping motor 16, by way of the pressure yoke 18, in the direction of displacement 28 along a line that is essentially perpendicular to the plane of the transport belt in relation to the print unit 1.

The motion transfer assembly is driven by a stepping motor 16 which, by means of bolts 26 and springs 25, is resiliently attached to the frame 24. This is most clearly shown in FIG. 2. Firmly mounted on the drive shaft 19 is a sleeve 20 which is provided with an outside thread and engages in a threaded bushing 21 on the pressure yoke 18. Depending on the direction of rotation of the drive shaft 19, the threaded bushing 21 moves either up or down in the direction of displacement 28 essentially perpendicular to the plane of the transport belt, whereby the pressure yoke 18 and the pressure roller 17 as well are shifted in that direction. A mechanical stop lug 22, mounted on the sleeve 20 and secured by a retaining ring 23, prevents the pressure yoke 18 from overshooting in the direction of the print head 3 which might otherwise cause the motion transfer assembly to destroy the print head 3. An overshoot of the pressure yoke 18 in the opposite direction is prevented by the threaded bushing 21 which, after traveling a specific distance, strikes against the frame 24. The pressure roller 17 is connected in conjugate fashion to a lateral guide 29 which, during the printing operation, centers the thermal transfer tape underneath the print head. Whenever the pressure roller 17 is moved downward, the guide 29 exposes an opening through which the thermal transfer tape can be easily exchanged.

For imprinting an object medium, the transport belt 11 moves the latter into the working space between the guide system 2 and the print unit 1 and into its target position where the motion transfer assembly presses the medium against the print unit containing the print head 3. The timing of the motion transfer assembly is controlled in such fashion that upon its arrival in the printing position the necessary amount of pressure is brought to bear on the object medium for that medium to be imprinted. During the movement of the object medium by means of the continuous-loop transport belt 11 the necessary traction of the object medium is provided by pressure rolls 15, with one such pressure roll 15 located on either side of the object medium to be imprinted. The transport belt 11 can move the object medium to the right and to the left in the direction of travel 27 that runs essentially parallel to the print unit 1. A stepping motor 13 drives the transport belt 11 via the guide rollers 12, while the power is transmitted by means of a timing belt 14.

Both the thermal transfer tape 4 and the object medium transported by the transport belt 11 travel past the print head 3 at a constant, linear speed, each driven by a stepping motor. The drive cylinder 7 is so dimensioned that per each step of the stepping motor 8 the thermal transfer tape 4 travels the same distance as does the object medium which is moved by a step of the stepper motor 13 driving the transport belt. This assures synchronous travel of the thermal transfer tape 4 and the object medium to be imprinted. By means of a control unit the tape speed of the thermal transfer tape 4 is adjustable, as is the feed rate of the object medium transported by the transport belt 11.

What is claimed is:

1. A thermal transfer printer comprising:

a guide system for an object medium to be imprinted;

a print head;

a print unit incorporating a transport for a thermal transfer tape;

a first drive unit including a transport belt and a drive;

a second drive unit for the direct, positive drive of the thermal transfer tape, moving the thermal transfer tape past the print head at a tape speed that is synchronized with a feed rate of the object medium to be imprinted;

a cylindrical pick up spool onto which spent thermal transfer tape is wound;

wherein the second drive unit includes at least one drive cylinder in direct contact with a circumference of the cylindrical pick up spool, thus driving said spool;

first and second stepper motors for driving the transport belt and the drive cylinder, respectively; and a control unit for synchronizing the tape speed of the thermal transfer tape and the feed rate of the transport belt.

2. The thermal transfer printer as in claim 1, wherein the drive unit moves the thermal transfer tape past the print head at a constant, linear speed.

3. The thermal transfer printer as in claim 1, wherein the drive unit comprises a motor.

4. The thermal transfer printer as in claim 1, wherein the pickup spool is so mounted as to be positionally displaceable relative to the drive cylinder.

5. The thermal transfer printer as in claim 1, wherein the pickup spool is exchangeably suspended in elongated slots.

6. The thermal transfer printer as in claim 1, wherein the drive cylinder contains a heating element.

7. The thermal transfer printer as in claim 6, wherein the heating element is a resistor.

8. The thermal transfer printer as in claim 7 wherein the resistor is a PTC resistor.

9. The thermal transfer printer as in claim 1, wherein the drive cylinder is provided with a circular groove.

10. The thermal transfer printer as in claim 1, further including:

a cylindrical supply spool which permits unreeling of unused thermal transfer tape for printing purposes.

11. The thermal transfer printer as claim 10, wherein, during a printing process, the thermal transfer tape is unreeled from the supply spool guided past the print head, and wound around the pickup spool.

12. The thermal transfer printer as in claim 10, wherein the supply spool incorporates a braking mechanism.

13. The thermal transfer printer as in claim 1, wherein the thermal transfer tape is guided by guide rollers and a lateral guide.

14. The thermal transfer printer as in claim 1, wherein the thermal transfer tape is guided by a cylindrical centering roller which is mounted in a slot.

15. The thermal transfer printer as in claim 14, wherein the cylindrical centering roller is conically tapered.

16. The thermal transfer printer as in claim 1, wherein the tape speed of the thermal transfer tape is adjustable.

17. The thermal transfer printer as in claim 1, wherein the guide system for the object material to be imprinted is positioned opposite the print head at a distance that leaves a defined working space, the guide system incorporating a transport unit and an adjustment device for varying a distance between the guide system and the print head.

18. The thermal transfer printer as in claim 1, wherein the drive unit further includes two guide rollers for guiding the transport belt.

19. The thermal transfer printer as in claim 1, wherein the transport belt is in the form of a continuous loop.

20. The thermal transfer printer as in claim 1, wherein the object material to be imprinted can be fed to the print head by means of the transport belt in a plane that extends essentially parallel to the print unit.

21. The thermal transfer printer as in claim 1, wherein the feed rate of the transport belt is adjustable.

22. The thermal transfer printer as in claim 1, further comprising an adjustment device which includes a drive and a motion transfer assembly which latter assembly is at least partly located within the continuous loop of the transport belt and is displaceable in relation to the same.

* * * * *